United States Patent [19]

Moranne

[11] 4,369,837

[45] Jan. 25, 1983

[54] TUBE FOR TUBE-PLATE HEAT EXCHANGERS

[75] Inventor: Jean-Pierre Moranne, Saint-Leu-La-Foret, France

[73] Assignee: Societe Anonyme des Usines Chausson, Hauts de Seine, France

[21] Appl. No.: 231,176

[22] Filed: Feb. 4, 1981

[30] Foreign Application Priority Data

Feb. 8, 1980 [FR] France ..... 80 02825

[51] Int. Cl.[3] ..... F28F 9/06

[52] U.S. Cl. ..... 165/175; 165/178

[58] Field of Search ..... 165/173, 175, 177, 178, 165/DIG. 13

[56] References Cited

U.S. PATENT DOCUMENTS

| | | | |
|---|---|---|---|
| 4,159,035 | 6/1979 | Chartet | 165/173 |
| 4,236,577 | 12/1980 | Neudeck | 165/175 |

FOREIGN PATENT DOCUMENTS

| | | | |
|---|---|---|---|
| 1396051 | 12/1965 | France | 165/175 |
| 2250087 | 5/1975 | France | 165/173 |
| 284338 | 1/1929 | United Kingdom | 165/177 |
| 879200 | 10/1961 | United Kingdom | 165/175 |

*Primary Examiner*—Sheldon J. Richter

*Attorney, Agent, or Firm*—Browdy & Neimark

[57] ABSTRACT

The tube has an oblong shape in cross-section with smaller sides rounded. The two ends of the tube are shaped so that the larger sides are formed with concavities making that in cross-section said two ends have a figure 8 shape over a portion of height corresponding at least to height of insertion of the tube in a tube plate.

6 Claims, 14 Drawing Figures

FIG. 1
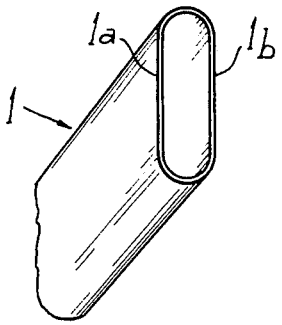
FIG. 2
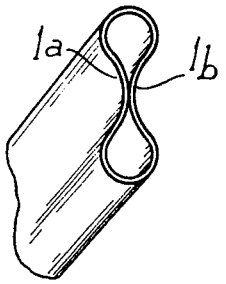
FIG. 3
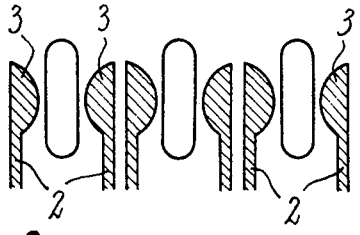
FIG. 4
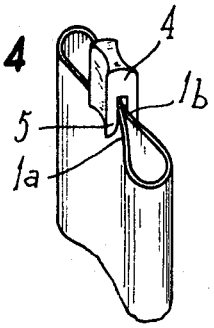
FIG. 3a
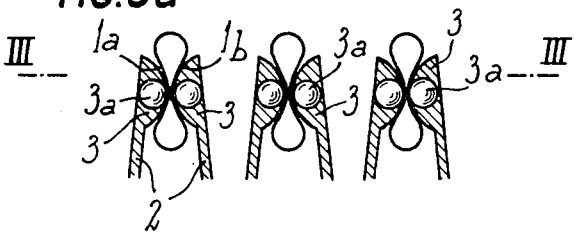
FIG. 5
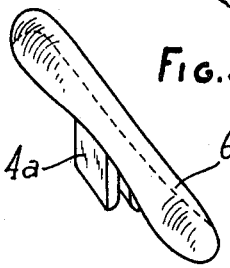
FIG. 3b
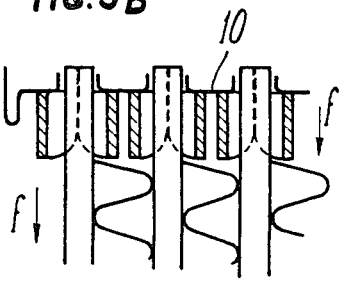
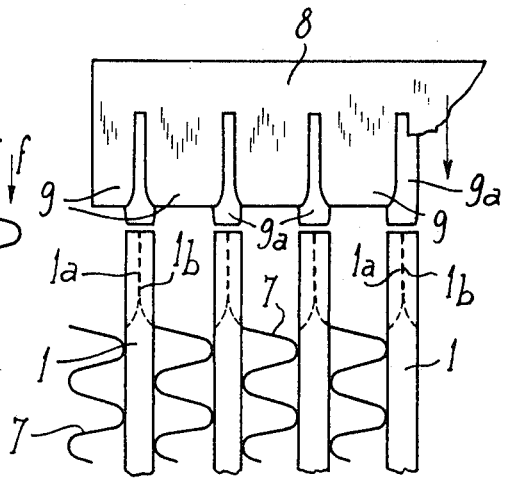
FIG. 6

TUBE FOR TUBE-PLATE HEAT EXCHANGERS

The present invention relates to a new tube for heat exchangers of the type of those used for cooling the circulation fluid of heat engines and it applies more particularly to tubes adapted for being mechanically jointed into tube plates.

By the term "mechanical jointing" is meant a force fitting of the tubes into tube passages provided or not with flanges formed in tube plates.

Most often, deformable sealing gaskets are inserted into tube passages of the tube plate for bearing against the wall of the tube and these sealing gaskets apply, by necessity, a large resilient force on the tube wall for providing a perfect tightness. The effort thus exerted is such that it has not been possible, till now, to use tubes other than tubes having a circular cross-section, and when this is not the case, reinforcement elements have to be previously introduced, into tubes of rectangular cross-section, for counter-balancing the force exerted by the resilient sealing gaskets on the larger sides of the rectangular tubes.

In the first case, which is that of round tubes, the heat exchange is little satisfactory, the cause being the shape of the tubes itself.

In the second case, the fabrication is very costly since the positioning of reinforcement elements in the tube ends is an operation difficult to carry out in mass production.

The present invention palliates the disadvantages of the cases hereabove mentioned, i.e. the invention offers their advantages while discarding their disadvantages.

According to the invention, the tube for tube-plate heat exchangers is characterized in that the tube has, in cross-section, a rectangular shape with smaller sides rounded over major portion of its length, the tube having its two ends shaped so that the larger sides are formed with concavities making that, in cross-section, said two ends have a figure 8 shape over a portion of height corresponding at least to height of insertion of the tube in a tube plate.

Various other features of the invention will appear more clearly from the following detailled description.

Embodiments of the invention are shown, by way of non limitative examples, in the accompanying drawings wherein:

FIG. 1 is a top perspective view of a heat exchanger tube of a conventional design, FIG. 2 is a perspective view similar to FIG. 1 illustrating how the tube is shaped at its two ends according to the invention, FIGS. 3 and 3*a* are diagrammatic top views illustrating how the shaping of the tube of FIG. 2 may be obtained, FIG. 3*b* is an elevation cross-sectional diagrammatic view taken along line III—III of FIG. 3*a* for illustrating a particular feature of the invention, FIG. 4 is a perspective view diagrammatically showing an other way of shaping the tube of FIG. 2 when the production is on a small scale, FIG. 5 is a perspective view of a shaping and positioning clamp of another type, FIG. 6 is a partial diagrammatic elevation view of a radiator core and of a forming tool more particularly adapted to mass production, FIG. 7 is a partial elevation exploded view of a radiator core, tube plate and header illustrating how the invention is performed, FIG. 8 is a sectional view substantially taken along line VIII—VIII of FIG. 7, FIG. 9 is a partial cross-sectional view similar to FIG. 7 of an alternative embodiment, FIG. 10 is a partial cross-sectional view similar to FIG. 8 and illustrating an alternative embodiment, FIG. 11 is a partial elevation cross-sectional view of a thick tube plate arranged according to the invention, FIG. 12 is an elevation cross-sectional view similar to FIG. 11 of an alternative embodiment.

In FIG. 1 the tube is shown at 1 and manufactured, in usual way, either by extrusion, or by bending and soldering or by any other means, so as to present an oblong cross-section with larger parallel sides and smaller rounded sides.

According to the invention, the ends of the larger sides 1*a*, 1*b* are deformed so that the inner walls of said larger sides are brought closer to each other, substantially at their median portion and, preferably, brought to bear against each other over a height at least equal, and advantageously slightly superior, to thickness of a tube plate or to height of flanges of the tube plate in which each tube is adapted for being inserted.

Thus, and as shown in FIG. 2, the tube ends have substantially the shape of a 8 figure.

For providing this conformation, various means may be contemplated.

FIG. 3 shows clamps 2 the jaws of which are provided with bosses 3 enabling, during tightening of said clamps, a shaping of walls 1*a*, 1*b*. The clamps of such type may be easily assembled on a common support and controlled by a cam device or similar, making thereby possible a simultaneous shaping of the tube ends of the core.

FIGS. 3*a* and 3*b* show an alternative embodiment according to which the bosses 3 contain balls 3*a* which are slightly protruding. In this way, it is possible first to clamp the tubes as near as possible of their ends, and to displace thereafter the clamps along the direction of arrow F as the tube plate 10 is being put in position.

When manufacturing is carried out at a slower rhythm and as shown in FIG. 4, shaping of walls 1*a* and 1*b* may be obtained by using a clamp 4 having the shape of a stirrup, the ends of which are formed with ramps 5 making easier insertion of the stirrup and shaping of walls 1*a*, 1*b*.

As shown in FIG. 5, it is advantageous that the clamp, which is then shown at 4*a*, is topped by a small bar 6 the top of which is convex and rounded. Thus the clamps 4*a* are left in position even after the tubes are inserted into the tube plates, the small bar 6 making easier insertion of the tubes into the tube plates and the flexible sealing gaskets which they must comprise and which will be described hereafter.

FIG. 6 shows still another way of shaping the walls 1*a*, 1*b* of the tubes 1, which may be already assembled with secondary heat exchange elements in the form of corrugated strips 7. In this case, a tool 8 is used which comprises punches 9 provided for shaping the sides 1*a*, 1*b* when they move down in direction of the arrow. Further to the punches 9, the tool 8 is advantageously provided with spindles 9*a* forming extra punches which are engaged in the two portions which have to remain open of the tube shaped as a 8 figure by the punches 9. The sizes of the spindles 9*a* are chosen so that the metal of the tube is deformed beyond the resilient limit, in order that the deformation remains once the tool is removed. Moreover, such an arrangement will enable a possible recentering of the tubes relative to each other.

The tubes which are shaped at their ends, as illustrated in the foregoing, are then inserted into tube plates 10 (FIGS. 7 and following).

In FIGS. 7 and 8, the tube plates are made, for example, of metal and formed with flanges 11 protruding upwardly but which could also protrude downwardly. Deformable gaskets 12 made for example of rubber are inserted into the flanges 11.

As shown in FIG. 8, the flanges 11 are of an oblong shape and have their smaller sides rounded so that, in cross-section, they have the same shape as that of the tube of FIG. 1. The gaskets 12 inserted inside the flanges have over-thicknesses 12*a*, 12*b* corresponding to concavities formed in the tube walls 1*a*, 1*b*.

FIG. 7 shows the tubes 1 provided with secondary heat exchange elements in the shape of corrugated strips 7 just before their insertion into the gaskets 12 which form an opening having, in cross-section, the same shape as that of the ends of the tubes 1, but this opening has smaller dimensions. Thus, when the tubes are force-fitted into the gaskets contained inside the flanges, the outer walls of the tubes are clamped by the gaskets, their over-thicknesses 12*a*, 12*b* exerting a resilient pressure which applies together the inner walls of the larger sides of the tubes in their median portion.

In a known manner, the gaskets 12 may be made by molding from a continuous plate 13 covering the face of the tube plate turned towards the header 14, and in this case the plate 13 may also form a gasket 15 adapted for ensuring a tightness between the tube plate 10 and the header.

In the foregoing, it has been considered that the tube plates were in metal and formed with flanges.

Figure 7:
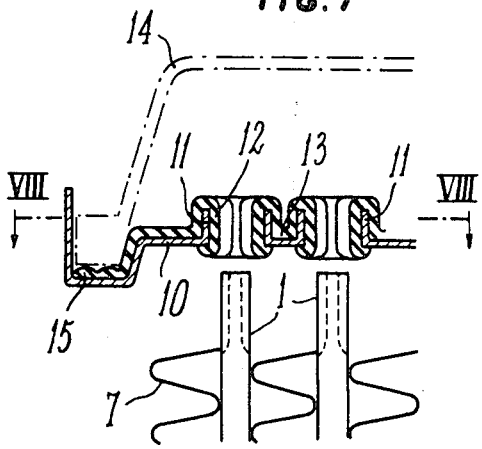
Figure 10:
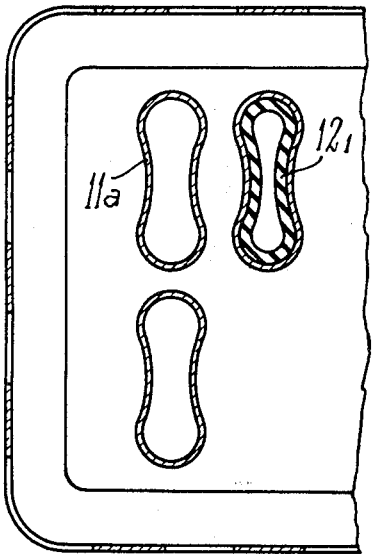
FIG. 10 illustrates an alternative embodiment according to which the flanges then shown at 11*a* are shaped when they are being cut and cambered for taking the same shape as that of the ends of the tubes 1. Thus, the gasket $12_1$, fitted into each flange, may have a thickness which is uniform or substantially uniform.
Figure 11:
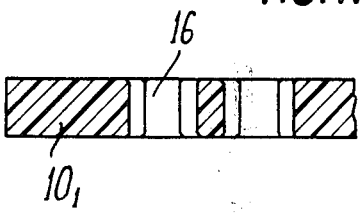

FIG. 11 shows that the invention can also be performed in a similar way by using tube plates $10_1$ which are thick, made for example by moulding of a metal or a synthetic material. In this case, it is advantageous that the tube passage openings 16 are shaped as a 8 figure, in the same way as the flanges 11*a* of FIG. 10.

Although the drawings do not show it, gaskets similar to those described with reference to FIG. 10 are then put in position.

Figure 8:
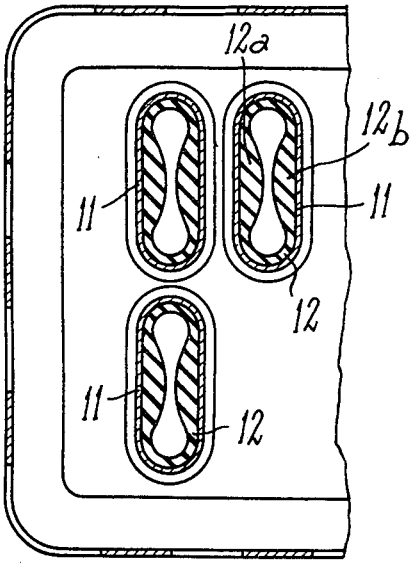

It is obviously possible that the tube passage openings 16 are rectangular with small rounded sides in the same way as the flanges 11 illustrated in FIG. 8, and in this case, the gaskets which are used are formed with over-thicknesses similar to those of said same FIG. 8.

Figure 12:
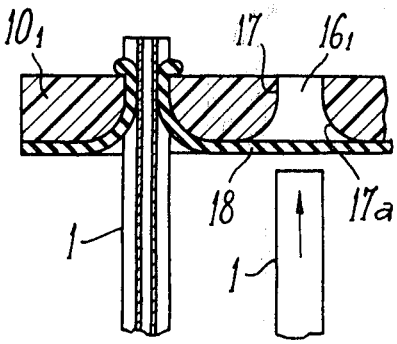
Figure 9:
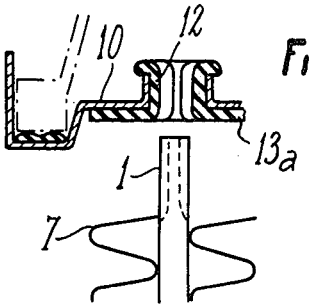
FIG. 9 shows that the continuous plate, shown at 13*a*, can also be positioned below the tube plate.

FIG. 12 illustrates still another development of the invention according to which the thick header plate $10_1$ is formed with tube passages $16_1$, shaped as a 8 figure over a portion 17 with rectilinear walls, preferably perpendicular to the plane defined by the tube plate. Then, the wall 17 is flared out as shown at 17*a* for defining an opening of a large size. In this case, the tubes 1, preferably shaped as described in the foregoing, may be positioned, but it is possible also to insert the tubes 1 directly, the ends of said tubes being then shaped directly inside the tube passages via the flared out walls 17*a*.

In this embodiment, the sealing gaskets may be put in position as described with reference to any one of the preceding figures, or it is also possible to use a mere deformable material sheet 18 some portions of which are introduced into the tube passages at the time of insertion of the tubes, shaping of the tubes 1 being therefore carried out simultaneously as the sheet 18 is being introduced. At the end of the introduction, the portion of the sheet which still covers the end of the tubes 1 is opened either by a cutting tool, or by the end as such of the tubes, as this is known in the art.

The invention is not limited to the embodiments shown and described in detail, and various modifications thereof may be carried out thereto without departing from its scope as shown in the appendent claims.

I claim:

1. A tube for tube-plate heat exchanger, said tube having two ends with a cross section of an oblong shape having substantially flat larger sides and rounded smaller sides, the two ends being shaped so that the larger sides are formed with concavities making that in cross section, said two ends have a figure 8 shape over a portion of height corresponding at least to height of insertion of the tube in a tube plate, wherein each tube is inserted into a deformable gasket having, along larger sides of the tube, convergent overthicknesses, said gasket being maintained into a tube passage or a flange of an oblong shape.

2. A tube according to claim 1, wherein flexible gaskets are interposed between the tube plate and the tube, said flexible gaskets applying, on the portion of the tube having a figure 8 shape, a resilient force over periphery of the tube.

3. A tube according to claim 2, wherein said resilient force brings the median portion of the inner walls of each of the larger sides in contact with each other.

4. A tube according to claim 1, wherein the tube passages are formed indifferently in a tube plate having flanges or in a thick tube plate made of a moulded material.

5. A tube according to claim 1, wherein the tube passages are formed in a portion only of the thickness of a thick tube plate, said tube passages being extended by a wall flaring out for cooperating with shaping of the tubes and positioning under pressure of the deformable gasket.

6. A tube according to claim 1, wherein each deformable gasket is formed from a continuous plate covering one or other side of the tube plate.

* * * * *